United States Patent [19]

Jones

[11] 4,062,517

[45] Dec. 13, 1977

[54] BODY FOR DISPENSER VALVE

[75] Inventor: Gerald Dovaston Jones, West Hill, Canada

[73] Assignee: Precision Valve Corporation, Yonkers, N.Y.

[21] Appl. No.: 769,734

[22] Filed: Feb. 17, 1977

Related U.S. Application Data

[63] Continuation of Ser. No. 407,544, Oct. 18, 1973, abandoned.

[30] Foreign Application Priority Data

Oct. 20, 1972 Canada ..... 154886

[51] Int. Cl.[2] ..... F16K 1/32

[52] U.S. Cl. ..... 251/322; 251/337; 251/353; 222/402.1

[58] Field of Search ..... 251/321, 322, 323, 353, 251/354, 349, 350, 351, 336, 337; 222/402.1

[56] References Cited

U.S. PATENT DOCUMENTS

| | | | |
|---|---|---|---|
| 1,351,780 | 9/1920 | Mead | 251/353 |
| 2,579,977 | 12/1951 | Sjolin | 251/322 |
| 3,038,446 | 6/1962 | O'Farrell | 251/321 X |
| 3,146,922 | 9/1964 | Tuttle, Jr. | 251/350 X |
| 3,404,863 | 10/1968 | Green | 251/353 |
| 3,800,825 | 3/1972 | Zoll | 251/322 X |

*Primary Examiner*—Arnold Rosenthal
*Attorney, Agent, or Firm*—Davis, Hoxie, Faithfull & Hapgood

[57] ABSTRACT

A valve body for a pressurized aerosol dispenser valve has an annular groove in the spring retaining nipple adjacent its junction with the remaining portion of the valve body to eliminate the "shaving" or "tail" scraped from the surface of the plastic of the valve body when the spring is placed on the spring retaining nipple of the valve body.

1 Claim, 3 Drawing Figures

BODY FOR DISPENSER VALVE

This application is a continuation of Ser. No. 407,544, filed Oct. 18, 1973, and now abandoned.

The present invention relates to valves for pressurized aerosol dispensers and more specifically to a grooved valve body for receiving a valve spring.

In the aerosol dispenser industry, it is desirable to attain a valve malfunction or failure rate as close to zero as possible. One cause of valve failure is clogging of the valve orifice with foreign matter. Since valve orifices are typically on the order of a few hundredths of an inch in diameter, it can be appreciated that the presence of any foreign object increases the possibility of clogging the valve orifice and therefore increases the probability of valve failure.

In assembling the conventional valve components of the prior art, the molded valve body is held in a fixed position and the valve body spring is axially aligned therewith. An axially advanced rotating valve spring installer device engages the end of the spring remote from the valve body and rotates the spring in the direction which tends to open the coils of the spring as the spring is advanced axially of the spring retaining nipple of the valve body. The spring slides over the spring retaining nipple and it is frictionally retained thereon. Rotation of the spring aids in placing the spring on the spring retaining nipple. The coils of the spring are expanded slightly in diameter during rotation of the spring so that the spring exerts a radial force on the spring retaining nipple. After assembly, a residue of this radial force serves to frictionally hold the spring on the nipple.

The conventional valve biasing spring is manufactured with the ends of the wire cut in a fashion which leaves a burr or sharp protruding edge of metal extending radially inward of the spring. Rotation of such a conventional spring about the nipple of the valve body causes the burr on the leading end of the spring to scrape or shave the surface of the nipple, producing a "shaving" or "tail" of plastic which may later find its way to the valve orifice and clog the valve orifice thereby making the valve unit defective. The bulk of the shaving is produced by scraping of the burr against the cylindrical surface of the nipple as a result of the movement of the burr with respect to the spring retaining nipple. The end of the spring can also produce a shaving of plastic after completion of the assembly if the user rotates the valve completion of the assembly if the user rotates the valve actuating button with respect to the container.

It is an object of the present invention to provide an improved integral plastic valve body for a pressurized aerosol dispenser valve.

It is a further object of the present invention to substantially reduce the extent of any shaving produced when placing the valve biasing spring on the spring retaining nipple of a valve body.

It is a further object of the present invention to provide an annular groove or channel in the spring retaining nipple adjacent the shoulder of the enlarged portion of the valve body.

It is a still further object of the present invention to provide a groove for causing any minor shaving to separate from the valve body and fall away during spring placement.

Other objects, aspects and advantages of the present invention will be apparent when the detailed description is considered with the drawing.

Briefly, the present invention relates to an improved valve body for a pressurized aerosol dispenser valve having an annular groove or channel in the spring retaining nipple adjacent its junction with the enlarged body portion of the valve body. This undercut prevents contact of the burred end of the spring with the nipple in the undercut and eliminates the bulk of the shaving produced when the valve body biased spring is placed upon the spring retaining nipple.

The invention is illustrated with the accompanying drawing as follows.

Figure 1:
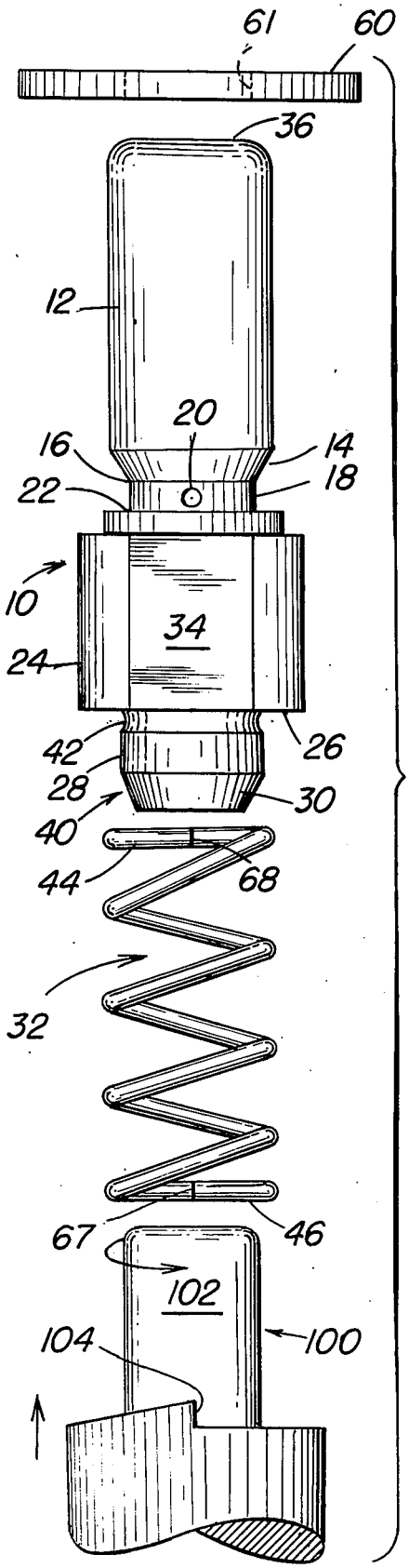
FIG. 1 is an exploded elevational view showing the improved valve body, the valve biasing spring, the valve gasket, and the spring installing tool before assembly.
Figure 3:
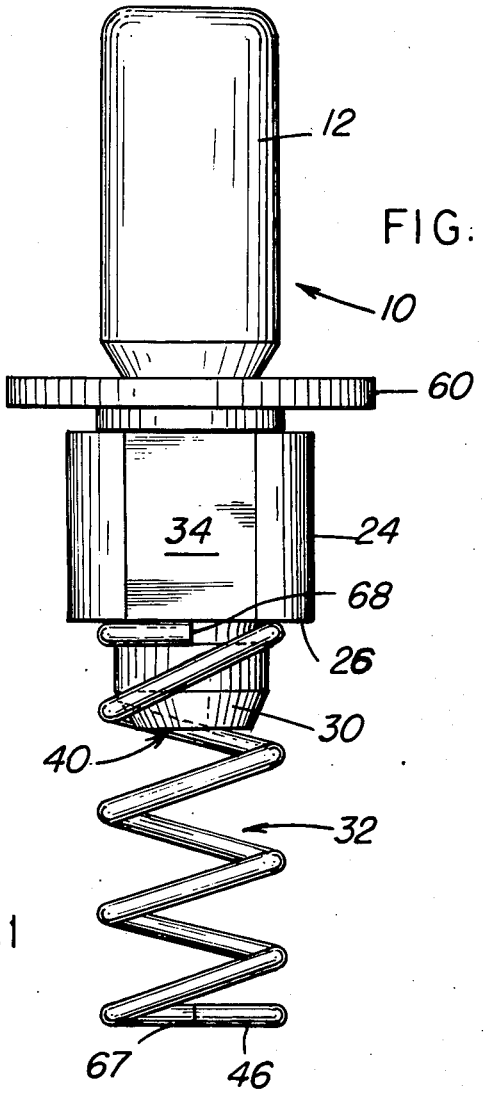
FIG. 3 is an elevational view of the assembled valve body, gasket and spring.

Referring to the drawings, the improved valve body 10 of the present invention is illustrated. The valve body 10 includes a hollow valve stem portion 12 which is generally cylindrical in shape with a tapered transition at one end forming a truncated conical portion 14. The truncated conical portion 14 is connected at its end 16 with neck portion 18 which is cylindrical in shape and which includes a transverse valve orifice 20 in communication with the hollow interior of the stem portion 12. The neck portion 18 of the valve body 10 is connected at its remote end 22 to an enlarged body portion 24 which is generally cylindrical, but includes flat portions 34 to allow for product flow. Connected to the remote end wall 26 of of the enlarged body portion 24 is a generally cylindrical spring retaining nipple 40 which is chamfered as its remote end 30 to aid in mounting a valve body biasing spring 32 thereon.

The improved integral plastic valve body 10 of the present invention includes an annular groove or channel 42 formed in the cylindrical surface 28 of the spring retaining nipple 40. The annular groove 42 is positioned adjacent the end wall or bottom wall 26 of the enlarged body portion 24 to receive the leading turn 44 of the biasing spring 32 is mounted on the spring retaining nipple 40 by relative rotation of the spring 32 in a direction which tends to open its coils. As shown by the curved arrow in FIGS. 1 and 2, this direction is counterclockwise.

The valve body 10, the gasket 60 and the biasing spring 32 are assembled using apparatus including a spring installer 100. This tool is caused to rotate and to axially advance with respect to the valve body 10. The valve biasing spring 32 is slipped over the pilot portion 102 of the installer tool. As the tool rotates, the cut end surface 67 of end turn 46 of springs 32 engages a detent 104 which permits the tool 100 to rotatively drive the spring 32 in a direction which tends to cause expansion of the diameter of the turns of the spring and which causes the spring to screw itself onto the nipple 40 of the valve body.

The rotating installer tool 100, carrying a spring 32 on its pilot portion 102 and having the cut end 67 of the spring in engagement with the detent 104, is axially advanced with respect to the valve body 10. The leading turn 44 of the spring intercepts the chamfered end 30 of the nipple 40 thereby centering the spring 32 and valve body 10. The conical portion 30 causes slight expansion of the diameter of the turns of the spring coil as the spring 32 rotates and axially advances. The spring 32 becomes slightly compressed axially and the leading turn 44 snaps over cylindrical portion 28 and into the groove 42 as soon as the spring diameter has been sufficiently expanded. The spring is retained on nipple 40 by seating of the leading turn 44 of the spring 32 in the annular groove 42. Additional retention is derived from the contraction of the spring coils about the cylindrical portion 28 of the nipple 40.

The installer tool 100 is further axially advanced until the end of the pilot portion 102 abuts the chamfered end 30 of the nipple 40 to push the valve stem portion 12 of the body through the aperture 61 of a resilient annular gasket 60. The stem portion 12 is pushed through the gasket 60 until the gasket 60 seats in the neck portion 18 over the orifice 20 to complete the assembly. The assembly is then removed from the installer tool 100. The assembly of the valve body 10, gasket 60 and spring 32 is later included in a valve housing, not shown, to form a complete pressurized aerosol dispenser valve unit of a well known type.

Figure 2:
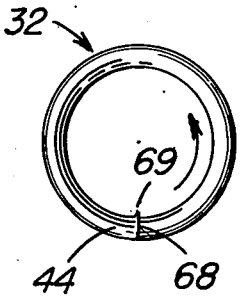
FIG. 2 is an enlarged end view of the valve biasing spring.

Referring now to FIG. 2, the leading turn 44 of a typical valve biasing spring 32 is shown. The end 68 of the leading turn 44 has been cut in the manufacture of the spring 32. The cutting of the end 68 results in a sharp edged burr 69 which protrudes into the interior of the spring 32. It is this burr which scrapes the plastic of the prior art valve body nipple to produce the troublesome shaving which may block the valve orifice. The relative motion of the spring and the conventional valve body results in the burr traveling a spiral path of considerable length along the cylindrical surface of the conventional nipple. Continued relative rotation of the spring further causes the burr to scrape away plastic shavings from the vicinity of the junction of the nipple and enlarged body portion.

The improved valve body of the present invention virtually eliminates these shavings. The path of the burr on the nipple of the present invention is much shorter and less spiral than that of the conventional body as a result of the snap action of the spring 32 which the present nipple encourages. The burr 69 rapidly slides longitudinally across the cylindrical portion 28 rather than scraping laterally as is more the case with the prior art. Further, the groove 42 effectively eliminates a portion of the axial length of the cylindrical portion 28 of the nipple 40 thereby shortening the distance the leading turn 44 of the spring 32 must travel before becoming seated in groove 42. Any minor shaving resulting from the longitudinal movement of the cut end 68, specifically the burr 69, across the cylindrical portion 28 of the nipple is terminated at the groove 42 and it falls away from the valve body 10 to further reduce the probability of clogging the valve orifice 20.

When seated, the cut end 68 of the spring resides in the groove 42 such that the burr 69 no longer contacts any portion of the nipple 40. That is, the diameter of the channeled or grooved portion of the nipple 40 is equal to or less than the inside diameter of the unexpanded spring 32 to be mounted on the nipple 40 for eliminating contact between the cut end 68 of the spring 32 and the nipple 40 when the cut end 68 of the spring 32 is mounted within the channel 42. Further, the axial width of the channel 42 is equal to or greater than the diameter of the spring wire.

It should be understood that the present invention is not restricted to the particular valve body illustrated in the drawing. The present invention may be employed with any aerosol valve in which a valve body biasing spring is mounted on the spring retaining nipple of a valve body. The present invention may be employed with axial or tilt action valves or valves capable of actuation by both axial and tilt action. Further, the valve body may have a single valve orifice or include a plurality of valve orifices.

What is claimed is:

1. In a valve unit for a pressurized dispenser having an assembly of a coiled wire biased spring having a burred end and a one piece molded plastic valve body having a hollow valve stem at one end, a neck portion having a transverse valve orifice in communication with the hollow valve stem interior, an intermedite enlarged portion, and, at the other end, a biasing spring retaining nipple for receiving and spring, said nipple including a chamfered end and a cylindrical portion of a diameter greater than the interior diameter of said spring coil, the improvement which comprises means for separating from the body a shaving caused by the burred end of the spring, which means comprise an annular groove recessed into the cylindrical portion of said nipple adjacent said enlarged portion, said groove having a width in the axial direction at least equal to the diameter of the spring wire, the diameter of said nipple at said groove being no larger than the interior diameter of said spring coil, said groove receiving the burred end of said spring to permit a shaving caused by passage of the burred end over the cylindrical portion of the body to be separated from the body upon entry of the burred end of the spring into the groove.

* * * * *

UNITED STATES PATENT AND TRADEMARK OFFICE

CERTIFICATE OF CORRECTION

PATENT NO. : 4,062,517

DATED : December 13, 1977

INVENTOR(S) : Gerald Dovaston Jones

It is certified that error appears in the above-identified patent and that said Letters Patent are hereby corrected as shown below:

Col. 1, lines 50-51, delete "the valve completion of the assembly if the user rotates"

Col. 2, line 11, "biased" should be --biasing--

Col. 2, line 38, "as" should be --at--

Col. 2, line 46, after "32", insert --when the spring 32--

Col. 4, line 29, "biased" should be --biasing--

Col. 4, line 35, "and" should be --said--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*